US012226871B2

(12) United States Patent
Memmelaar, Jr. et al.

(10) Patent No.: US 12,226,871 B2
(45) Date of Patent: Feb. 18, 2025

(54) TROCAR NEEDLE GRINDER

(71) Applicant: Royal Master Grinders, Inc., Oakland, NJ (US)

(72) Inventors: John R. Memmelaar, Jr., Midland Park, NJ (US); Todd R. Morris, New Windsor, NY (US)

(73) Assignee: Royal Master Grinders, Inc., Oakland, NJ (US)

( * ) Notice: Subject to any disclaimer, the term of this patent is extended or adjusted under 35 U.S.C. 154(b) by 1033 days.

(21) Appl. No.: 17/168,742

(22) Filed: Feb. 5, 2021

(65) Prior Publication Data

US 2021/0245325 A1 Aug. 12, 2021

Related U.S. Application Data

(60) Provisional application No. 62/970,888, filed on Feb. 6, 2020.

(51) Int. Cl.
*B24B 41/06* (2012.01)
*B24B 9/00* (2006.01)
(Continued)

(52) U.S. Cl.
CPC ..... *B24B 41/061* (2013.01); *B24B 9/007* (2013.01); *B24B 19/16* (2013.01); *B24B 41/06* (2013.01); *B24B 41/00* (2013.01)

(58) Field of Classification Search
CPC ..... B24B 9/007; B24B 41/005; B24B 41/06; B24B 41/061; B24B 19/16; B24B 3/605; B24B 3/607
(Continued)

(56) References Cited

U.S. PATENT DOCUMENTS 2,525,264 A * 10/1950 Milner ..... B24B 19/16 451/213
3,539,314 A * 11/1970 Dery ..... B24B 19/16 451/194
(Continued)

FOREIGN PATENT DOCUMENTS

CN 204711811 U 10/2015
CN 108340247 A * 7/2018 ..... B24B 21/008
(Continued)

OTHER PUBLICATIONS

CN-109048569-A English Translation (Year: 2018).*
CN-108340247-A English Translation (Year: 2018).*

*Primary Examiner* — Makena S Markman
(74) *Attorney, Agent, or Firm* — Lerner David LLP

(57) ABSTRACT

Disclosed herein is a fixture for a workpiece, a system and a method for performing a machining operation using the fixture. The fixture may include a frame, a plurality of holders, an actuator and a bracket. Each holder may be configured to receive and secure a workpiece. Each holder may be rotationally coupled to the frame. The actuator may be operatively coupled to the plurality of holders to drive rotation of the holders with respect to the frame. The bracket may allow for mounting the frame to a manipulator configured to move the fixture. The method may include the steps of loading a workpiece to the holder of the fixture, moving and/or rotating the workpiece by the actuator to perform one or more ancillary operations on the workpiece, and moving/and or rotating the workpiece by the actuator to grind the workpiece against a grinding surface.

14 Claims, 20 Drawing Sheets

(51) Int. Cl.
*B24B 19/16* (2006.01)
*B24B 41/00* (2006.01)

(58) Field of Classification Search
USPC ..... 451/398, 382
See application file for complete search history.

(56) References Cited

U.S. PATENT DOCUMENTS

| | | | | | |
|---|---|---|---|---|---|
| 4,173,100 | A | | 11/1979 | MacBroom, Jr. | |
| 5,282,715 | A | * | 2/1994 | Abbate | B24B 41/06 414/757 |
| 5,575,708 | A | * | 11/1996 | Chau | B24B 19/16 451/305 |
| 6,015,338 | A | | 1/2000 | Hong et al. | |
| 10,098,660 | B2 | | 10/2018 | Park et al. | |
| 2015/0142038 | A1 | | 5/2015 | Melsheimer | |

FOREIGN PATENT DOCUMENTS

| | | | | | |
|---|---|---|---|---|---|
| CN | 109048569 | A | * | 12/2018 | B24B 1/00 |
| CN | 209648455 | U | | 11/2019 | |

* cited by examiner

TROCAR NEEDLE GRINDER

CROSS-REFERENCE TO RELATED APPLICATIONS

This application claims the benefit of the filing date of U.S. Provisional Patent Application No. 62/970,888 filed Feb. 6, 2020, the disclosure of which is hereby incorporated herein by reference.

FIELD OF THE INVENTION

The present invention relates generally to a fixture for a workpiece and a system for performing a machining operation, and in particular relates to a fixture for holding and manipulating a workpiece and a system for performing a machining operation using the fixture.

BACKGROUND OF THE INVENTION

Cannulas are manufactured, inter alia, by grinding hollow tubes against a grinding surface. The cannulas are loaded in a cartridge or fixture and positioned against a grinding surface. The cannulas must be rotated one or more times during the grinding process to achieve the desired cannula point style. For example, a trocar is produced by rotating the cannula at least twice to generate the three flat bevels required for the trocar. Grinding can be performed using various grinding methods including electrochemical grinding.

In addition to the grinding operation, various other operations are required to complete the manufacture of a cannula. For example, various pre-processing operations are needed to prepare the cannula for grinding, and various post-processing operations are required to prepare the cannula for use after grinding. During these various operations, the cannula or cannulas must be moved from one work station to another, securely held in place, and moved and rotated in each workstation to complete the processing step at each workstation.

The various steps involved in cannula manufacturing require considerable time and effort to move the cannulas through each of the workstations and manipulate them during each manufacturing step. Thus, an improved cannula manufacturing system and method is desired.

BRIEF SUMMARY OF THE INVENTION

In certain embodiments, the present disclosure relates generally to a fixture for a workpiece. In other embodiments, the present disclosure relates to a system for performing a machining operation using the fixture. In still other embodiments, the present disclosure relates to a method for performing a machining operation using the fixture.

In an aspect of the present disclosure, a fixture for holding a plurality of workpieces is provided. In accordance with this aspect, the fixture may include a frame, a plurality of holders, an actuator and a bracket. Each holder may be configured to receive and secure a workpiece. Each holder may be rotationally coupled to the frame. The actuator may be operatively coupled to the plurality of holders to drive rotation of the holders with respect to the frame. The bracket may allow for mounting the frame to a manipulator configured to move the fixture.

Continuing in accordance with this aspect, the holders may be collets configured to releasably secure the workpieces.

Continuing in accordance with this aspect, each of the holders may be coupled to a respective holder gear. The actuator may include a shaft having a shaft gear. The shaft gear may be operatively coupled to the holder gears to drive rotation of the holders with respect to the frame.

Continuing in accordance with this aspect, the fixture may include a support structure located away from the holders to minimize or eliminate workpiece deflection during a machining operation. The shaft gear may be operatively coupled to the holder gears by a coupler gear. In one aspect, the coupler gear may be a linear actuator. The linear actuator may include a rack gear driven by a pinion comprising the shaft gear. The actuator may include an electric motor for driving rotation of the shaft. In another aspect, the coupler gear may be a first helical gear. The first helical gear may extend along the shaft. The first helical gear may be substantially parallel to the shaft. An axis of rotation of the first helical gear may be parallel to the shaft. The first helical gear may be operatively coupled to the shaft gear by a pulley drive. The pulley drive may include a belt coupling the shaft gear to the first helical gear.

Continuing in accordance with this aspect, the fixture may include a support structure located away from the holders to minimize or eliminate workpiece deflection during a machining operation.

Continuing in accordance with this aspect, the manipulator may be a robot. The robot may include an arm having a distal end including a rotational actuator. The fixture may be configured to be coupled to the distal end of the arm such that the actuator of the fixture is operatively coupled to the rotational actuator of the robot.

In a further aspect of the present disclosure, a robotic end effector for holding a plurality of workpieces is provided. A robotic end effector according to this aspect may include a plurality of holders, a shaft, a first coupling gear and a second coupling gear. Each holder may be configured to receive and secure a workpiece. Each holder may be coupled to a respective holder gear. The shaft may include a shaft gear. The shaft may be attached to a robot configured to rotate the shaft and move and position the robotic end effector with respect to a grinding wheel. The first coupling gear may be coupled to the shaft gear. The second coupling gear may be coupled to the first coupling gear and the holder gears. A rotation of the shaft by the robot may cause each of the plurality of workpieces to simultaneously rotate about each workpiece axis via the respective holder gear, the first coupling gear and the second coupling gear.

In a further aspect of the present disclosure, a grinding system is provided. A grinding system according this embodiment may include a grinding surface, an end effector, and a robot. The end effector may include a frame with a plurality of holders. Each holder may be configured to receive and secure a workpiece. Each holder may be rotationally coupled to the frame. The actuator may be operatively coupled to the plurality of holders to drive rotation of the holders with respect to the frame. The robot may be coupled to the actuator of the end effector. The robot may be configured to rotate the actuator and move and position the end effector with respect to the grinding surface such that the workpieces may contact the grinding surface to grind the workpieces in a first position of the end effector, and may not contact the grinding surface in a second position of the end effector. A rotation of the actuator may cause each of the plurality of workpieces to simultaneously rotate about each workpiece axis.

Continuing in accordance with this aspect, each of the holders may be coupled to a respective holder gear. The actuator may include a shaft having a shaft gear. The shaft gear may be operatively coupled to the holder gears to drive rotation of the holders with respect to the frame. The shaft gear may be coupled to the holder gears via a coupler gear. The shaft gear may be coupled to a first coupler gear and a second coupler gear. The second coupler gear may be coupled to the holder gears.

Continuing in accordance with this aspect, the rotation of the actuator by the robot may be performed in the second position.

Continuing in accordance with this aspect, the holders may be configured to receive and secure trocars.

Continuing in accordance with this aspect, the grinding system may be an electrochemical grinding system.

In a further aspect of the present disclosure, a method for grinding a workpiece is provided. A method according to this embodiment may include the steps of (i) loading a workpiece to a holder of an end effector, (ii) moving and/or rotating the workpiece by an actuator to perform one or more ancillary operations on the workpiece, and (iii) moving/and or rotating the workpiece by the actuator to grind the workpiece against a grinding surface. The holder may be rotationally coupled to a frame. The actuator may be operatively coupled to the holder to drive rotation of the holder with respect to the frame.

Continuing in accordance with this aspect, the ancillary operations may include any of a pre-grinding operation and a post-grinding operation. The pre-grinding operations may include any of retrieving feedstock and cutting feedstock. The post-grinding operations may include any of deburring, grit blasting, inspection and electropolishing of the workpiece.

Continuing in accordance with this aspect, the workpiece may be a trocar.

Continuing in accordance with this aspect, the actuator may be a robot. The method may further include the step of attaching the robot to the end effector.

Continuing in accordance with this aspect, the instruction to perform steps (i) to (iii) are communicated via a human-machine interface.

BRIEF DESCRIPTION OF THE DRAWINGS

A more complete appreciation of the subject matter of the present disclosure and the various advantages thereof may be realized by reference to the following detailed description, in which reference is made to the following accompanying drawings.

DETAILED DESCRIPTION

Reference will now be made in detail to the various embodiments of the present disclosure illustrated in the accompanying drawings. Wherever possible, the same or like reference numbers will be used throughout the drawings to refer to the same or like features. It should be noted that the drawings are in simplified form and are not drawn to precise scale. Additionally, the term "a," as used in the specification, means "at least one".

As used herein, the terms "cannula" and "workpiece" will be used interchangeably and as such, unless otherwise stated, the explicit use of any terms is inclusive of the other term. Similarly, the terms "fixture," "end effector," and "robotic end effector" will be used interchangeably and as such, unless otherwise stated, the explicit use of any of these terms is inclusive of the other term.

Figure 1:
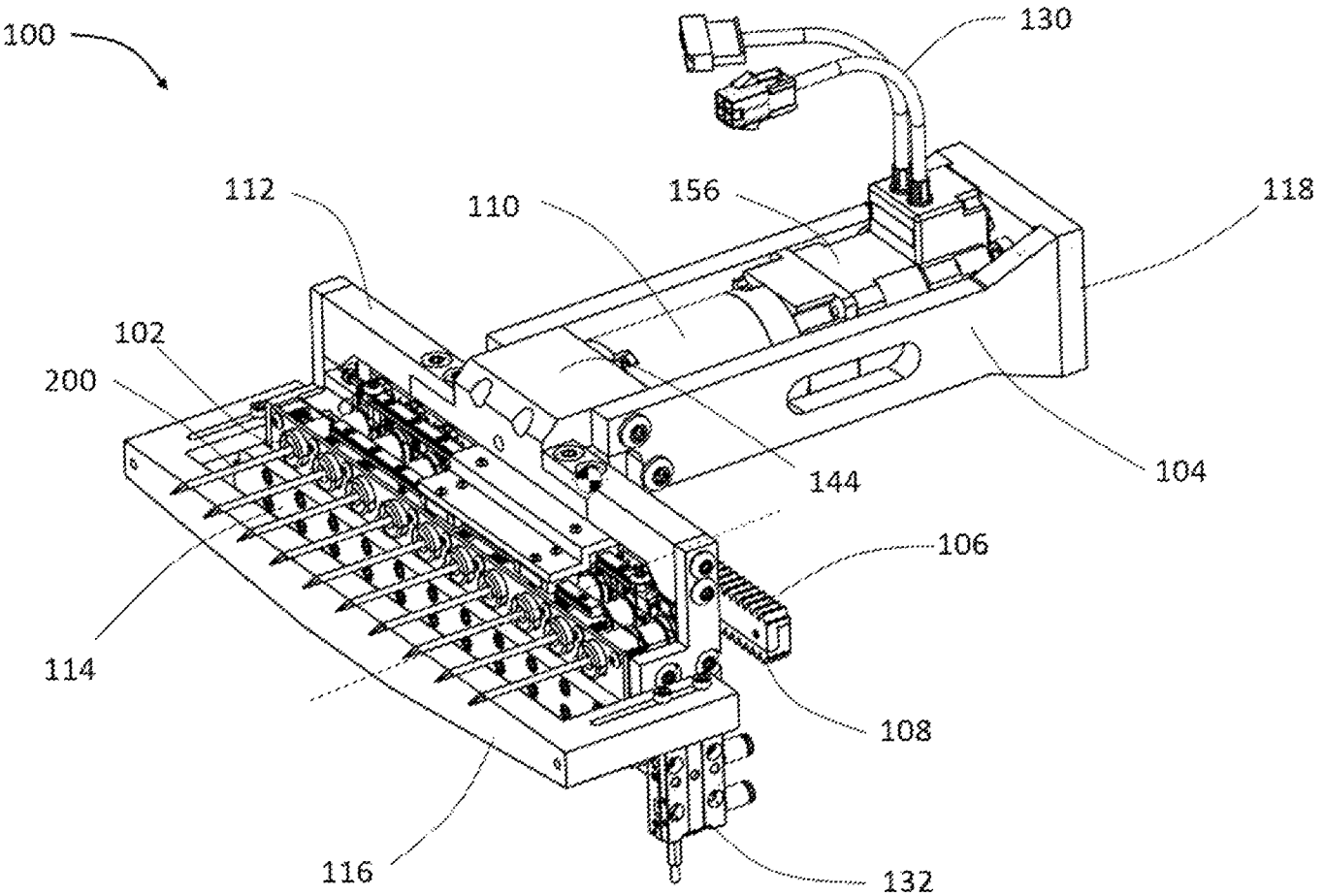
FIG. 1 is a front perspective view of a fixture according to an embodiment of the present disclosure.
Figure 2:
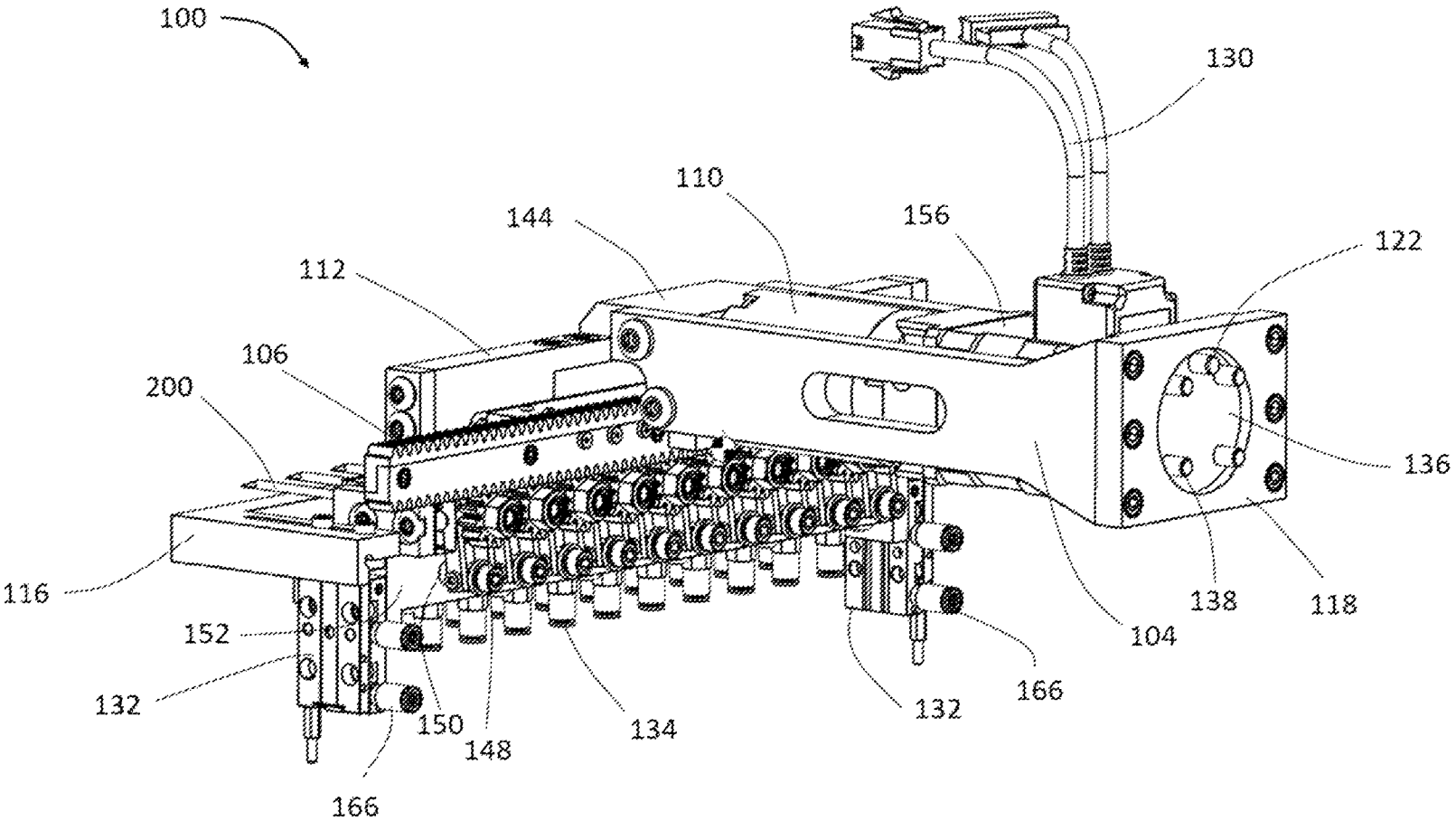
FIG. 2 is a back perspective view of the fixture of FIG. 1.

FIGS. 1 and 2 show front and back perspective views of a fixture 100 according to an embodiment of the present disclosure. Fixture 100 includes a frame holding a plurality of collets 102 for receiving and securing one or more workpiece 200. Collets 102 can accommodate workpieces of varying thicknesses and lengths as more fully described below. Each workpiece 200 can be loaded onto a collet 102 and firmly secured to same. A shaft 110 connects collets 102 to a manipulator such as a robot (not shown) via a linking structure 144 and a set of mounting arms 112. Shaft 110 is enclosed by a bracket 104 which includes an attachment end 118 for attachment to the robot. One or more connections 130 for control and/or power for the fixture are provided on shaft 110 as best shown in FIG. 1. For example, the connections 130 may control a motor 156 for driving the rotation of the shaft 110. The motor 156, which may be an electric motor such as a stepper motor or servomotor, is shown positioned within bracket 104.

Fixture 100 includes a support structure 116 to minimize or eliminate deflection of workpieces 200 during a machining process such as grinding. Workpieces 200 extend past support structure 116 to allow the workpieces to contact a grinding surface (not shown). When the workpieces are pressed against the grinding surface to grind the work pieces, support structure 116 acts as a back support to minimize or eliminate deflection of workpieces during grinding.

Fixture 100 includes a plurality of attachment structures 132 that allow fixture 100 to be docked or attached to other structures such as machining bed or other tool. A plurality of ports 134 are provided on a base 152 to actuate pistons 150 to open and close collet 102 as more fully explained below. Attachment end 118 includes a recess 136 to receive a corresponding head (not shown) from the robot. Attachment end 118 includes a plurality of fasteners 138 and a dowel 122 configured to engage with a distal end of the robot to firmly attach fixture 100 to the robot. Coolant ports (not shown) can be provided on fixture 100 to allow for coolant flow to traverse around the fixture to maintain operating temperature of the fixture at desired levels.

Figure 3:
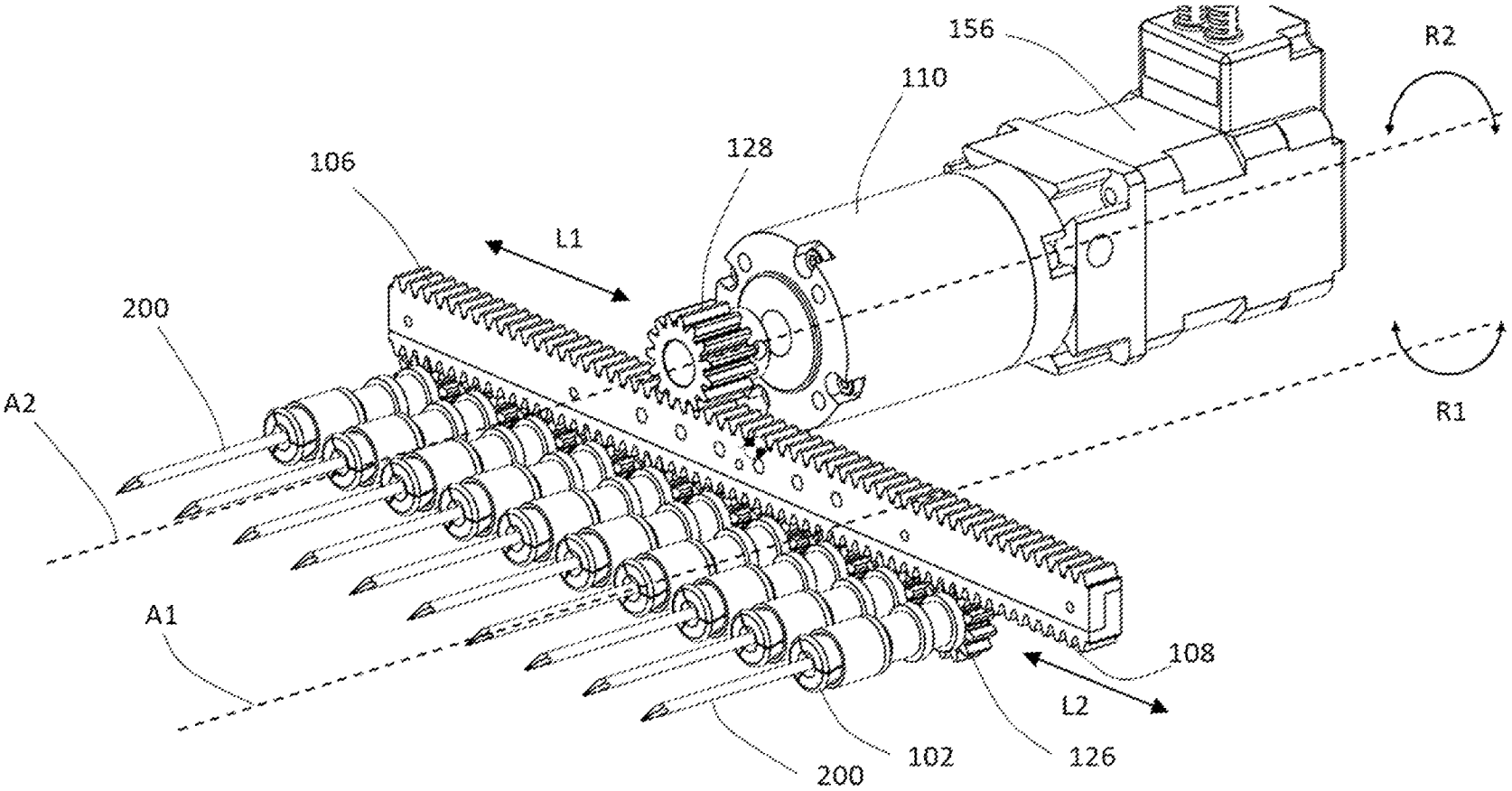
FIG. 3 is a front perspective view of an actuator mechanism of the fixture of FIG. 1.

Referring now to FIG. 3, there is shown a front perspective view of the actuator mechanism of fixture 100. Shaft 110 includes a shaft gear 128 coupled to a top gear rack 106. Shaft gear 128 and top gear rack form a rack and pinion arrangement wherein a rotation R2 of shaft gear 128 cause a linear translation L1 of rack 106. Rotation of shaft gear 128 is performed by rotating shaft 110 about a central shaft axis A2 as shown in FIG. 3.

Top gear rack 106 is attached to a bottom gear rack 108 such that the top and bottom gear racks move together. As shown in FIG. 3, linear translation L1 of top gear rack 106 causes a similar linear translation L2 of bottom gear rack 102. Each collet 102 is coupled to a collet gear 126. The collet gears are in turn coupled to the bottom gear rack 108, forming a second rack and pinion arrangement wherein linear translation L2 of bottom gear rack causes a rotation R1 about workpiece central axis A1. Therefore, rotating shaft 102 causes a rotation of each workpiece 200. The rotation of each workpiece with respect to the rotation of shaft 110 can be controlled as desired by adjusting the gear ratios. For example, increasing the rack and pinion gear ratio will provide more precision in work piece rotation, whereas decreasing the rack and pinion gear ration will provide for faster work piece rotation. Although two gear racks and two rack and pinion arrangements are shown in this embodiment, other embodiments can have only one rack and pinion arrangement to translate rotation R2 of shaft 110 to rotation R1 of each workpiece. While a linear translation mechanism with rack and pinion arrangement is used to translate rotation R2 of shaft 110 to rotation R1 of each workpiece 200 in this embodiment, other embodiments can have other gear arrangements such as herringbone gear, bevel gear, worm gear, internal gear, etc. to translate rotation R2 of shaft 110 to rotation R1 of each workpiece 200. For example, a chain or belt drive could be used to connect shaft 110 and collets 102, such as by having the shaft gear 128 and collet gears 126 be in the form of sprockets connected to a loop of roller chain. In other embodiments, a linear translation of shaft 110 can be used to rotate each workpiece 200.

Figure 4:
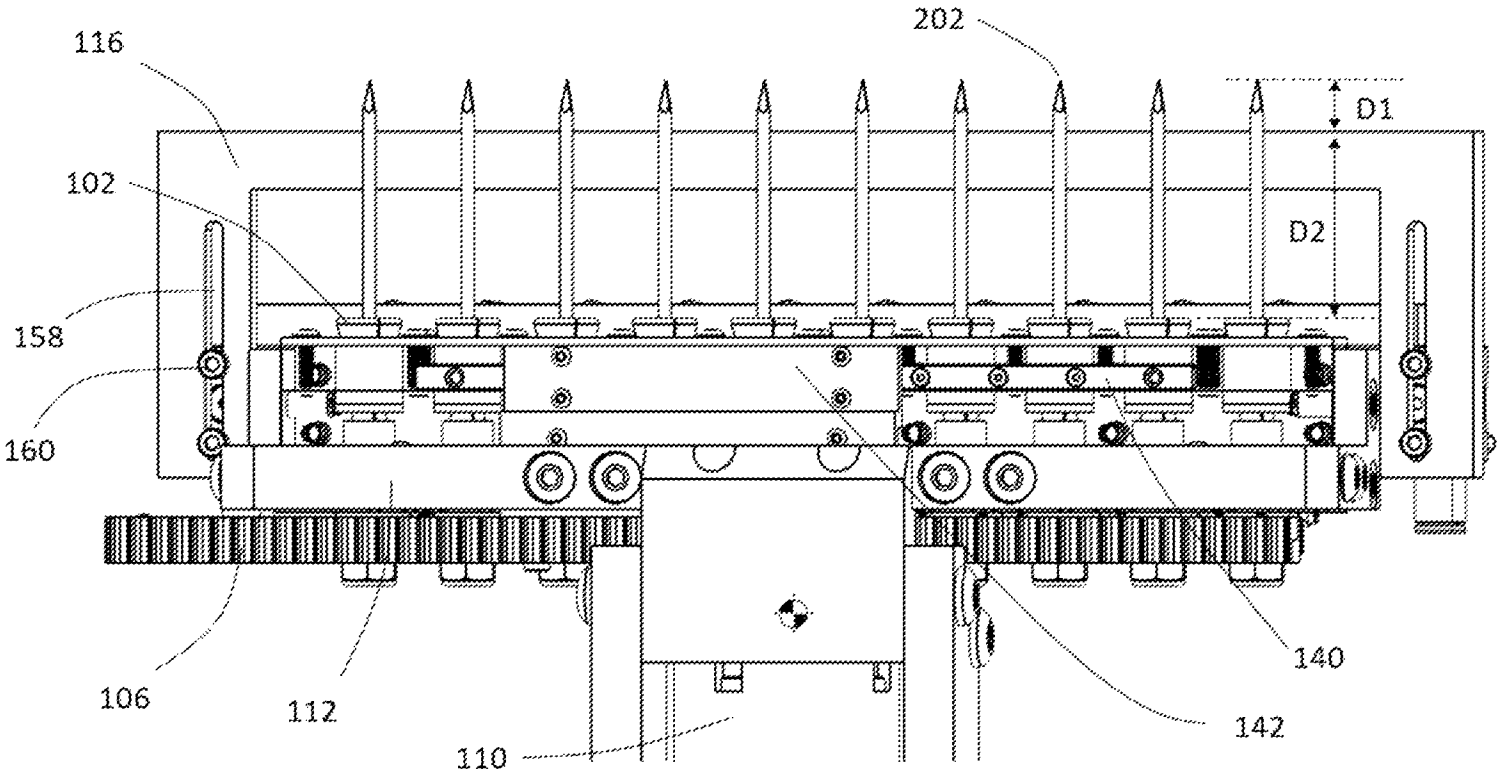
FIG. 4 is a top view of the actuator mechanism of FIG. 3.

FIG. 4 show a top view of the actuator mechanism of fixture 100. A distance D1 between a distal end 202 of workpiece 200 and support 116 defines an overhang of the workpieces past the support. A distance D2 between a distal face of collet 102 and support 116 of workpiece 200 defines the distance between a fixed end (collet 102) and a free end (workpiece above support 116). Thus, the section of workpiece 200 defined by distance D2 acts as a cantilever when the workpiece does not contact support 116. Distances D1 and D2 can be adjusted by moving support 116. For example, a linear slot 158 and one or more locking bolts 160 can be used to slide support 116 to a different location and lock that new location. Such adjustability can be utilized when grinding workpieces made of brittle material and/or small thickness, for example, by minimizing distance D1 in order to reduce flexion of workpiece 200 during grinding. Support 116 adjustment to vary distances D1 and D2 can be performed by a manipulator such as a robot to automate the adjustment as desired. Thus, the robot can adjust these distances based on input from an operator. Pneumatic or hydraulic ports 166 as shown in FIG. 2 allow for pneumatic or hydraulic control of support 116. For example, support 116 can be lowered to allow for loading of workpiece 200 to collet 102, and raised back to provide deflection support for the workpieces during grinding using the pneumatic or hydraulic control.

Linear rails 140 connect collets 102 and are attached to shaft 110 via an attachment as best shown in FIG. 4. Base 152 includes pistons 150 connected to u-arms 148 as best shown in FIG. 2. An end cap 114 secures pistons 150 to base 152 as shown in FIG. 1.

Figure 5A:
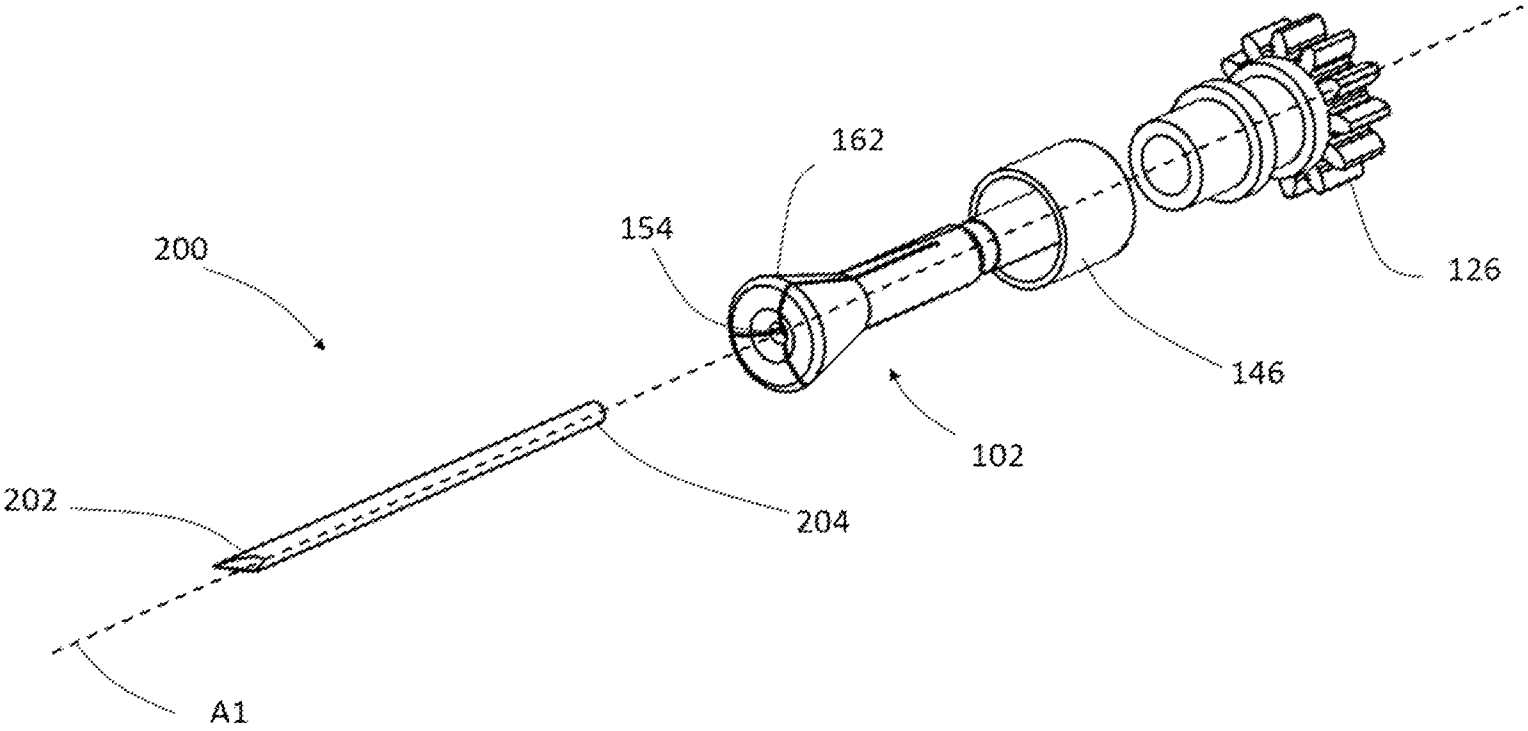
FIG. 5A is an exploded view of a holder of the fixture of FIG. 1.

FIG. 5A shows an exploded view of workpiece 200, collet 102 and collet gear 126. Workpiece 200 includes distal end 202 and a proximal end 204. Distal end 202 in this embodiment is a trocar with a three bevel surfaces. Other embodiments can have other cannula point styles including, but not limited to, diamond point, trephine, back bevel, menghini, razor edge, etc. Fixture 100 of the present disclosure can be utilized with any grinding system including an electrochemical grinding system. A diameter of a collet opening 154 can be increased or decreased to receive and secure the proximal end 204 of workpiece. In particular, relative translation between a bushing 146 and the collet 102 along axis A1 causes a tapered end 162 of the collet 102 to be progressively clamped within the bushing 146, thus decreasing the size of opening 154 to grip the workpiece 200. Workpiece 200 can also be loaded through a rear opening (not shown) of collet 102.

Figure 5C:
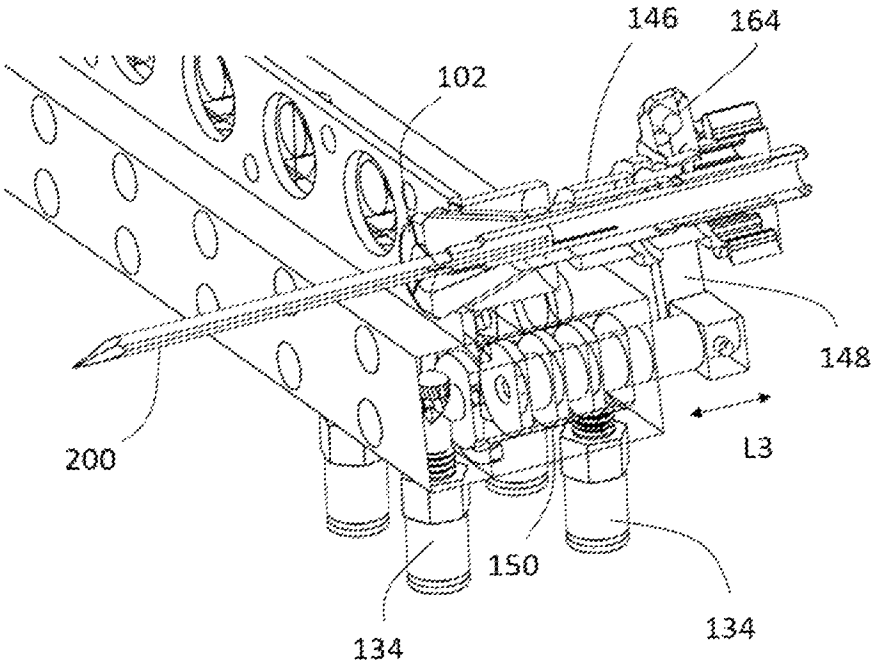
FIG. 5C is a partial sectional view of the actuating mechanism of FIG. 5B taken along a line A-A.
Figure 5B:
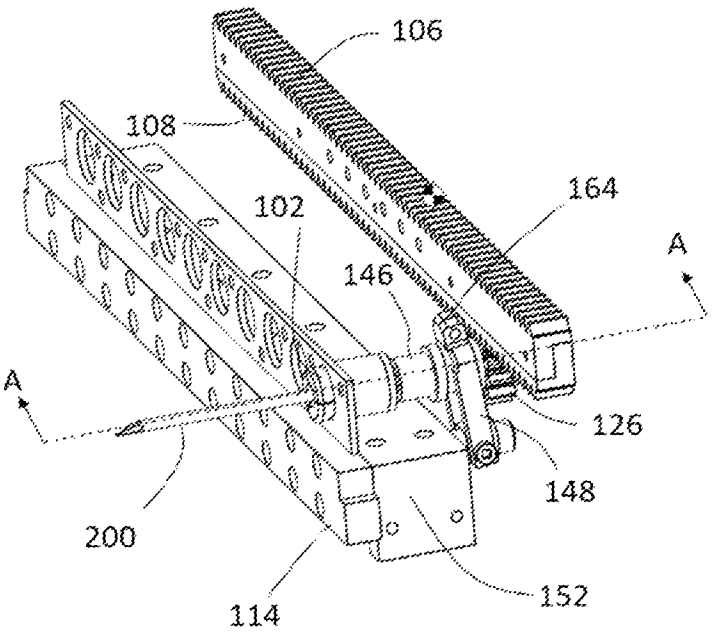
FIG. 5B is a partial perspective view of an actuating mechanism for the holder of FIG. 5A.

FIGS. 5B and 5C show a perspective views of the actuating mechanism to open and close collet 102. Each piston 150 is connected to ports 134. Ports 134 may be hydraulic or pneumatic ports to effect linear translation L3 of piston 150 as best shown in FIG. 5C by hydraulic or pneumatic means, respectively. Extension of piston 150 away from end cap 114 pushes u-arm 148 arm to pivot the u-arm about a pivot 164, which in turn causes collet gear 126 to pull back collet 102 into bushing 146 to thereby close opening 154. When piston 150 moves towards end cap 114, collet gear 126 pushes out collet 102 from bushing 146 to open the collet. In another embodiment, a rigid link connected to the piston can be used to move the collet directly in or out of the bushing. Thus, linear translation L3 of piston causes u-arm 148 to effect relative motion between collet 102 and bushing 146 to secure and release workpiece 200. Linear translation L3 can be performed by a manipulator such as robot to allow loading/unloading and adjustment of workpiece 200 within collet 102 to be fully automatic.

While fixture 100 is generally described here in conjunction with a grinding operation, fixture 100 can be used in any other machining operation to receive, secure, manipulate and release workpieces. While fixture 100 is generally described here as being used with a robot, any other manipulating means from a manual to a fully automated means can be utilized in other embodiments. Although rotation of shaft 110 is generally described as being performed by a manipulator such as a robot, motor 156 can rotate shaft 110 independently without the need for a manipulator in another embodiment. In other embodiments, motor 156 can work in conjunction with a manipulator such as a robot to effect shaft rotation.

Figure 6:
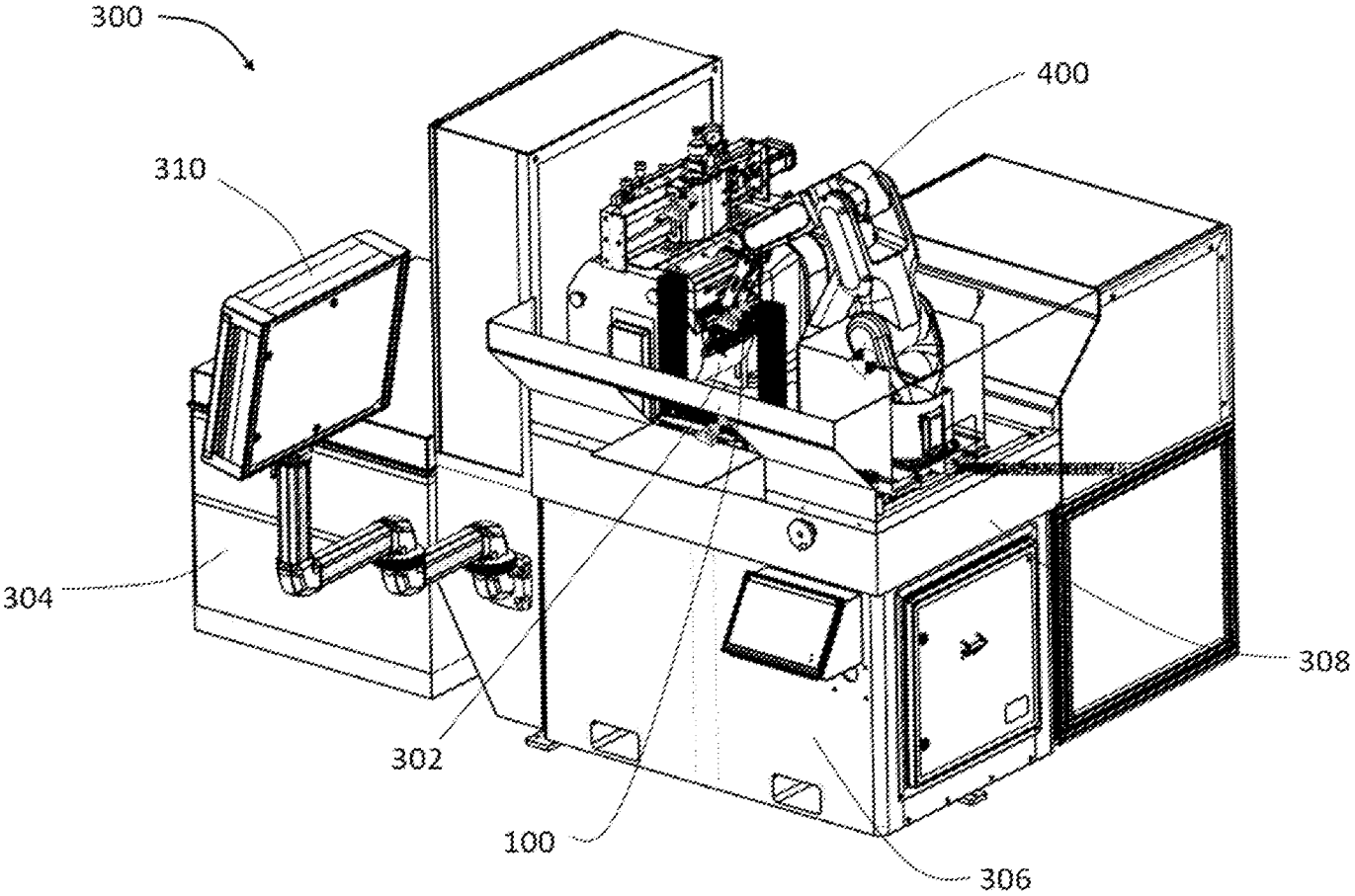
FIG. 6 is a perspective view of a grinding system according to another embodiment of the present disclosure.

Referring to FIG. 6, there is shown a perspective view of a machining system according to another embodiment of the present disclosure. While a grinding system 300 is shown as an example in this embodiment, other machining systems such as a cutting system, welding system, drilling system, etc. can be used in other embodiments. Grinding system 300 includes fixture 100 coupled to a robot 400. The grinding system includes a grinding wheel 302 for grinding workpieces and a coolant tank 304 which supplies coolant for the grinding operation. A machine base 306 with a machine bed 308 are also provided as shown in FIG. 6. A control panel 310 provides input for operator control and a display to monitor the grinding process. An operator can monitor and control the grinding operation through control panel 310.

Figure 7:
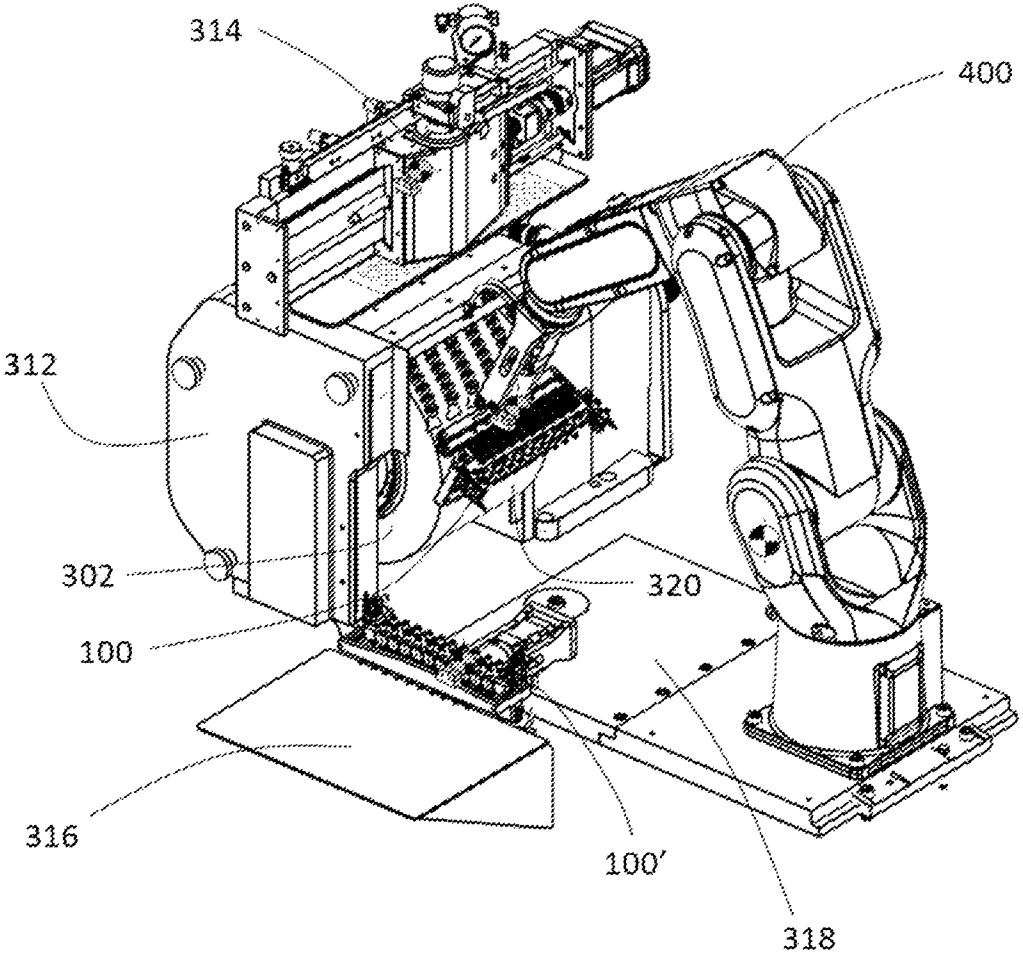
FIG. 7 is a perspective view of a robot attached to a fixture of the grinding system of FIG. 6

FIG. 7 shows details of grinding wheel 302 of grinding system 300. Grinding wheel 302 includes a grinding surface 320. A grinding wheel guard 312 protects an operator and the surroundings during the grinding operation. A motor 314 and various other accessories are located above grinding surface 320. A grinding bed 318 is located below grinding surface 320. A second fixture 100' with pre-loaded workpieces is located on a shelf 316 close to grinding surface 320 and in proximity to robot 400.

Figure 8:
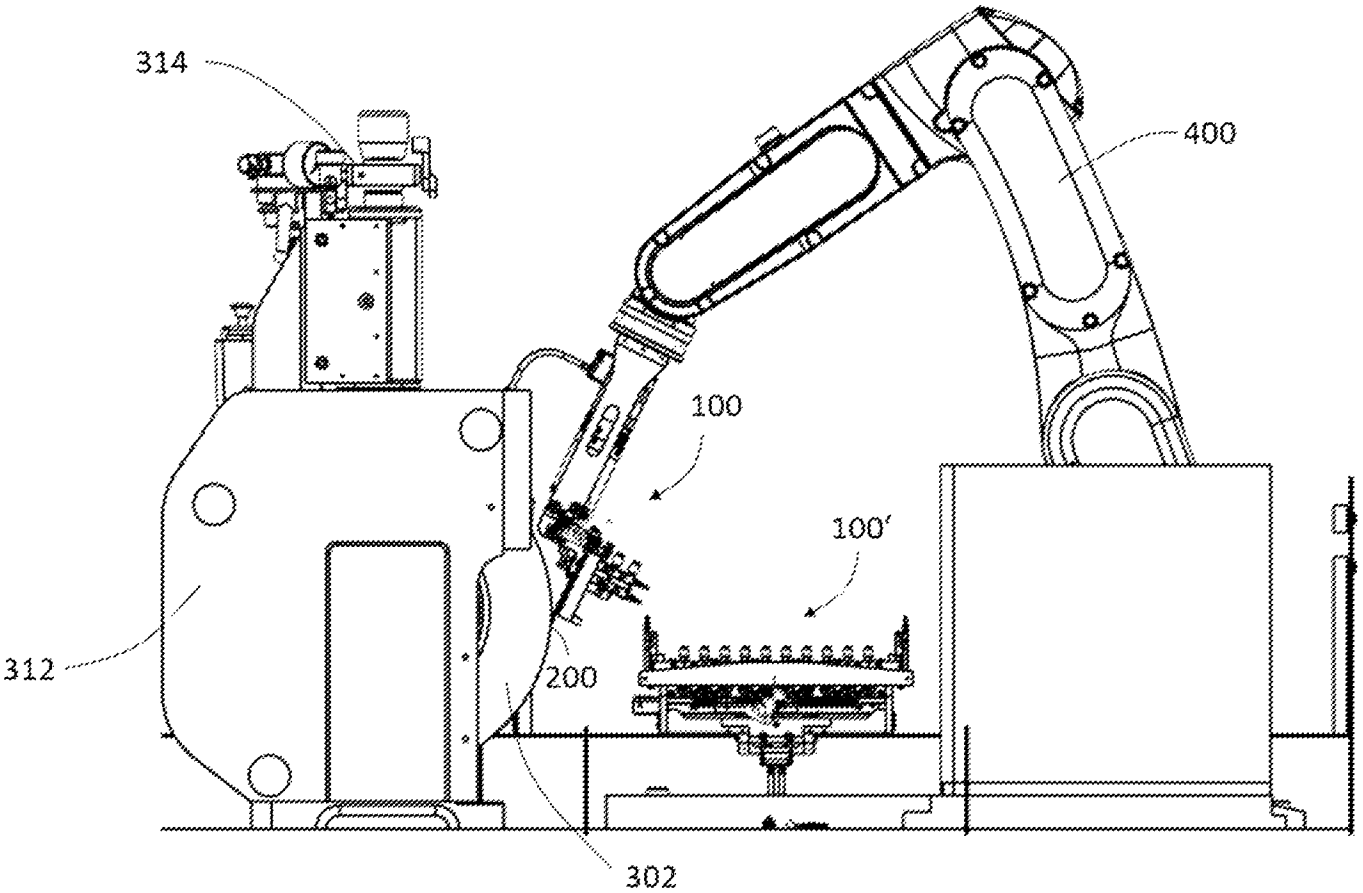
FIG. 8 is side elevation view of the robot and the fixture of FIG. 7.
Figure 9:
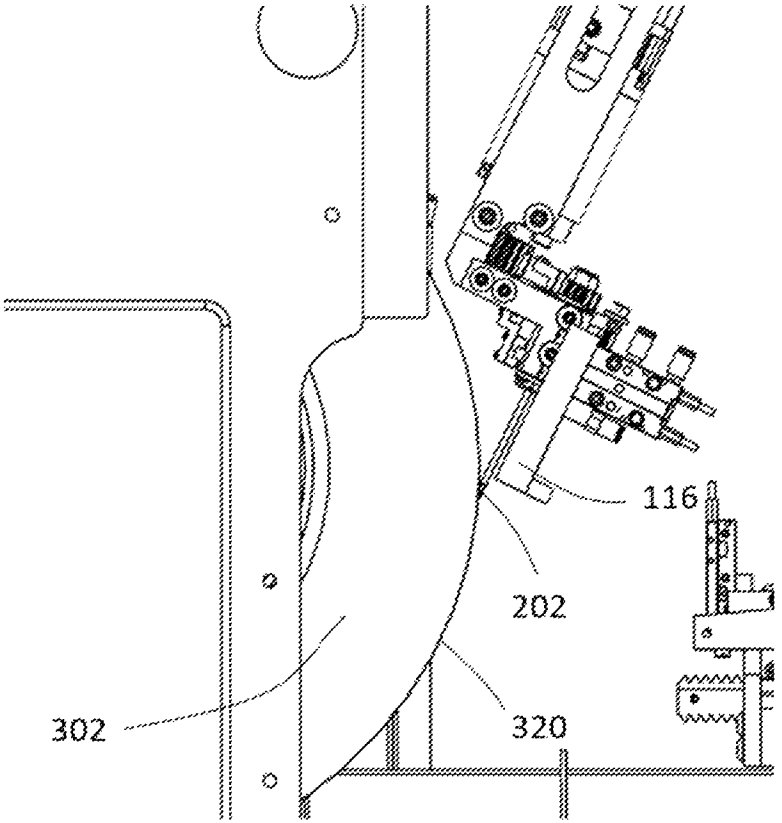
FIG. 9 is a close-up side elevation view of the robot and the fixture of FIG. 7.
Figure 10:
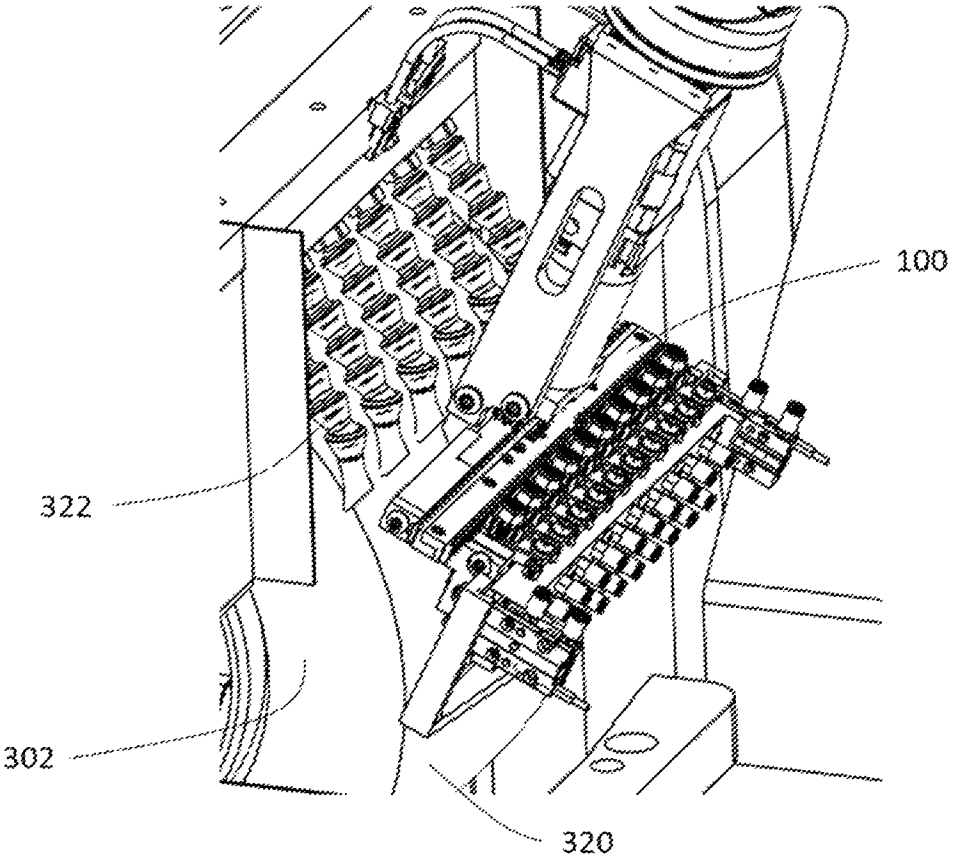
FIG. 10 is a perspective view of a grinding operation of the grinding system of FIG. 6.

Referring now to FIGS. 8-10, there are shown various views of a method of performing a grinding operation using grinding system 300 according to another embodiment of the present disclosure. Workpieces 200 are loaded into collets 102 of fixture 100. Robot 400, which is coupled to fixture 100, positions fixture 400 such that distal ends 202 of workpieces 200 contact grinding surface 320 as shown in FIG. 9. A coolant is applied across grinding surface 320 via a plurality of injection hoses 322, to reduce thermal damage and remove debris from the workpieces. After grinding a first bevel surface on distal ends 202 of workpieces 200, robot 400 moves fixture 100 away from grinding surface 320, and rotates the workpieces by rotating shaft 110 of fixture 100 as more fully described above. Depending on the type of workpiece style—i.e., trocar, diamond point, etc., this process is repeated until the workpiece grinding is complete and the desire shape is achieved. Robot 400 can now disengage from fixture 100 with the completed workpieces, and pick up fixture 100' with the pre-loaded workpiece and perform the grinding operation on the new workpieces.

Figure 11:
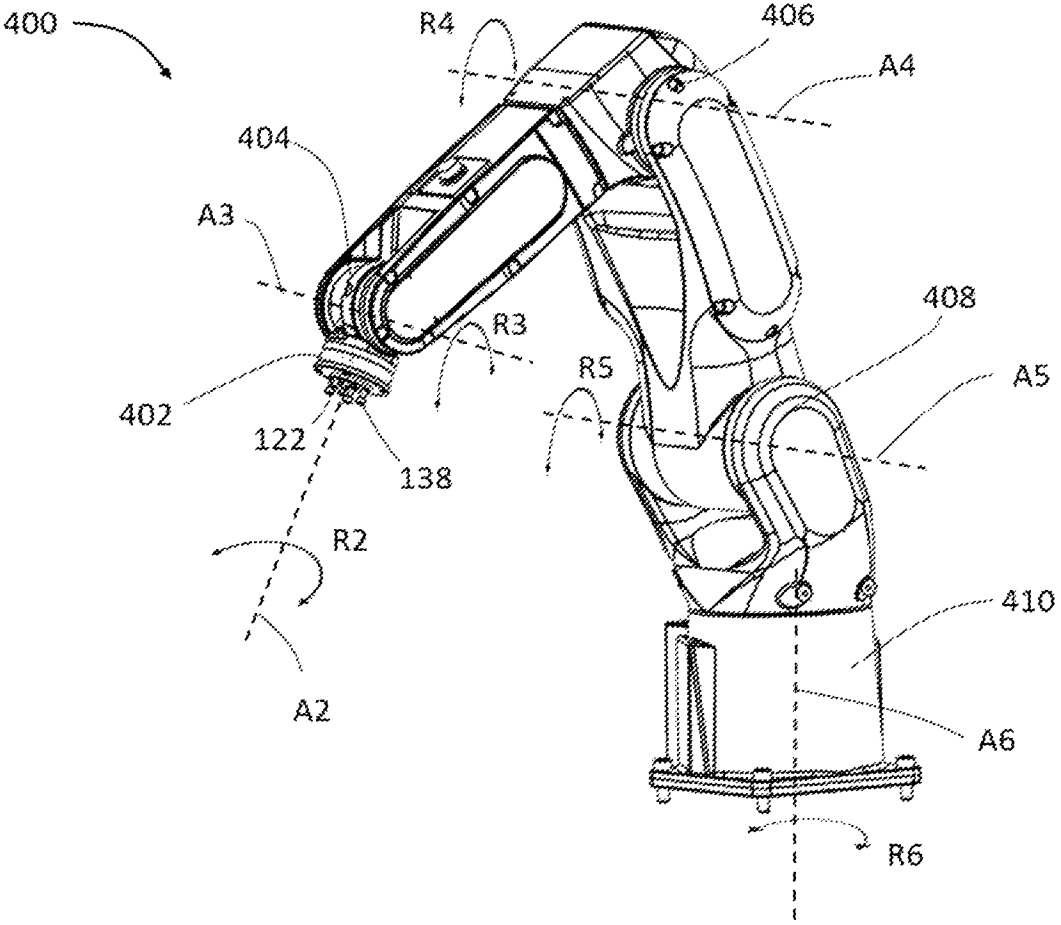
FIG. 11 is a perspective of the robot of the grinding system of FIG. 6.

Referring now to FIG. 11, there is shown an example of a robot 400 that can be used with fixture 100 in grinding system 300. Robot 400 includes a head 402 configured to be received in recess 136 of fixture 100. Fasteners 138 and dowel 122 are used to secure robot 400 to fixture 100 via head 402. Head 402 may include an actuator configured to rotate about shaft 110 axis A2. Robot 400 includes joints 404, 406 and 408. Each of these joints is configured to rotate about their respective axis. Joint 404 rotates about axis A3 to produce rotation R3. Similarly joints 406 and 408 rotated about axis A4 and A5 to produce rotations R4 and R5 as best shown in FIG. 11. Further, a base 410 of robot 400 attached to grinding system 300 can rotate about an axis A6 to produce a rotation R6. Thus, in addition to the rotation of shaft 110 about shaft axis A2, robot 400 can position head 402 in via the various degrees of freedom offered by the joint to enable 360 degree placement of fixture 100. It should be noted that fixture 100 of the present disclosure can be used with a robot with 2, 3, or 4 degrees of freedom to perform a grinding operation.

Figure 12:
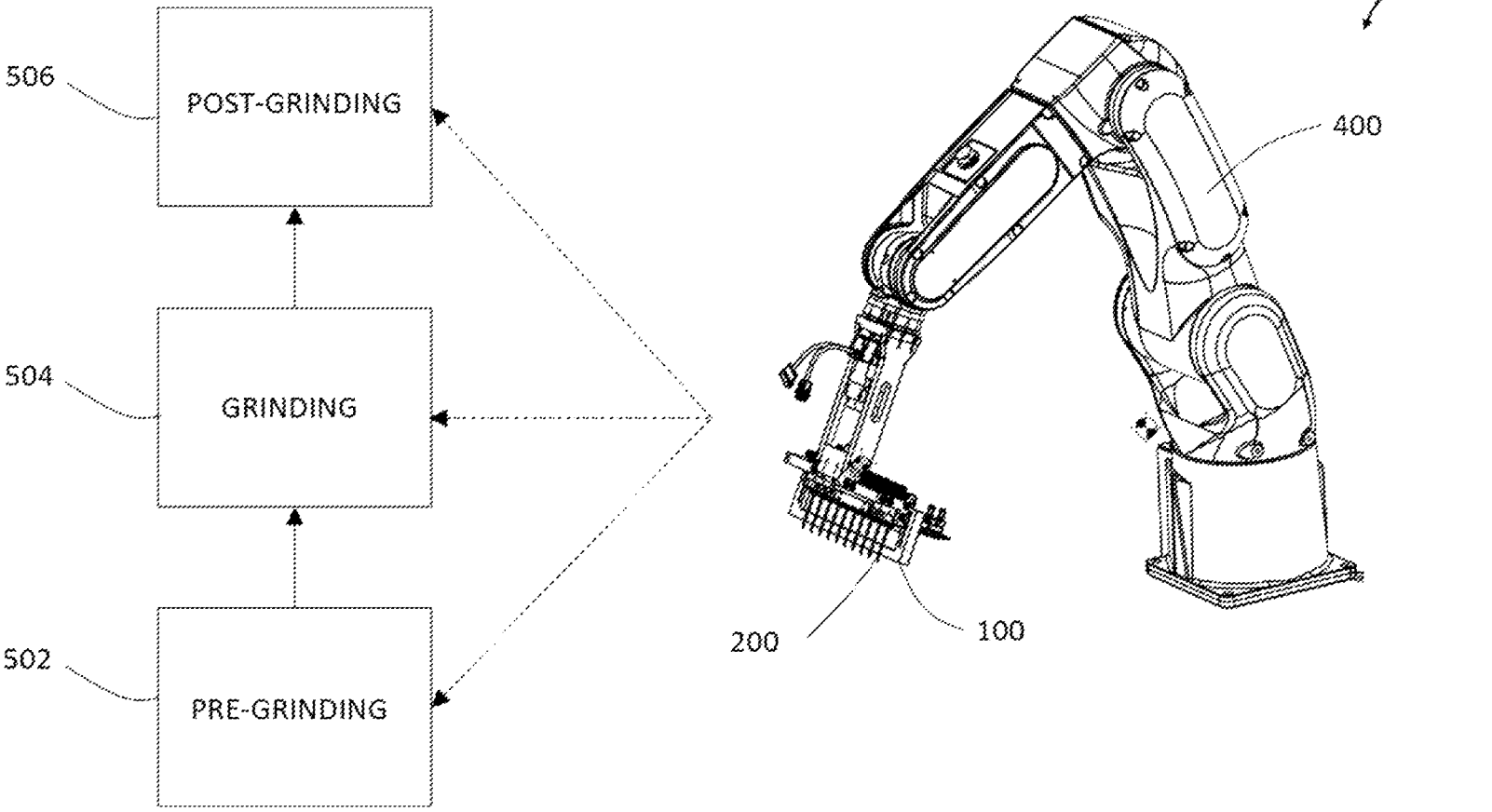
FIG. 12 is schematic view of a machining system according to another embodiment of the present disclosure.

FIG. 12 shows a schematic view of a machining system 500 using fixture 100 and robot 400 according to another embodiment of the present disclosure. While machining system 500 describes a fully automated cannula manufacturing system, the machining system disclosed herein can be used for machining any other product. Cannula manufacturing system 500 represents a fully automated or semi-automated cannula manufacturing system, where all or most of the manufacturing steps are performed by robot 400 by manipulating workpieces loaded on fixture 100. Cannula manufacturing system 500 includes pre-grinding operations 502, grinding operations 504 and post-grinding operations 506. Fixture 100 can be manually pre-loaded with workpieces 200 while the fixture 100 is coupled with robot 400, or the fixture can be manually pre-loaded with workpieces 200 while the fixture 100 is disconnected from robot 400, after which the fixture 100 can be coupled to the robot 400. In another alternative, robot 400 can automatically load workpieces 200 in fixture 100 while the fixture 100 is attached to the robot 400.

With fixture 100 containing workpieces 200 coupled to robot 400, robot 400 can move the workpieces to different pre-grinding operations 502. The robot 400 can also manipulate the workpieces during any of the pre-grinding operations 502, such as by moving to change the position and orientation of the fixture 100, and/or by rotating the workpieces via shaft 110. Examples of pre-grinding operations include, but are not limited to, cutting workpieces to the desired lengths by electrochemical or abrasive cutting methods, pre-grinding cleaning, pre-grinding testing, etc. Robot 400 is configured to adjust the length of workpiece extending through collets 102 by opening collets and pushing workpieces against a backstop to achieve the desired lengths.

After completing the pre-grinding operations 502, robot 400 positions and manipulates fixture 100 such that workpieces 200 are placed against a grinding surface to impart the desired cannula distal end shape as more fully explained above.

Once the cannulas are ground to the desired shape, robot 400 moves fixture 100 through one or more post-grinding operations 504. As with the pre-grinding operations, robot 400 can manipulate workpieces during each of the post-grinding operations 504, such as by moving to change the position and orientation of the fixture 100, and/or by rotating the workpieces via shaft 110. Examples of post-grinding operations include, but are not limited to, grit blasting, inspection (and additional grinding to fix deficiencies if necessary), electropolishing, packaging, etc.

Machining system 500 allows an operator not only to control the operations of the system using a human-machine interface ("HMI"), such as control panel 310 illustrated in FIG. 6, but the HMI is also desirably configured to allow for robot 400 to be programmed and re-programmed from the HMI itself, rather than using a separate "teach box" or "teach pendant" connected to the controller for the robot. Furthermore, on account of the fixture design of the present disclosure which allows full maneuverability of the workpieces—i.e., complete rotation and placement of the workpieces, an operator can conveniently program robot 400 (e.g., via HMI) to perform multiple different machining operations. Consequently, the machining system of the present disclosure provides a fully automated robotic machining process, which can easily be programmed to fabricate (e.g., via grind and pre-/post-processes) a variety of different components, such as different needle styles for a cannula or trocar. In contrast, conventional automated machine tending processes utilize robots to primarily perform one or more specified tasks (such as loading and unloading functions) in a machining operation set up to fabricate a particular component, and substantial amount of effort is required to design and implement the different sequence of processing operations necessary to fabricate a different component.

Figure 13:
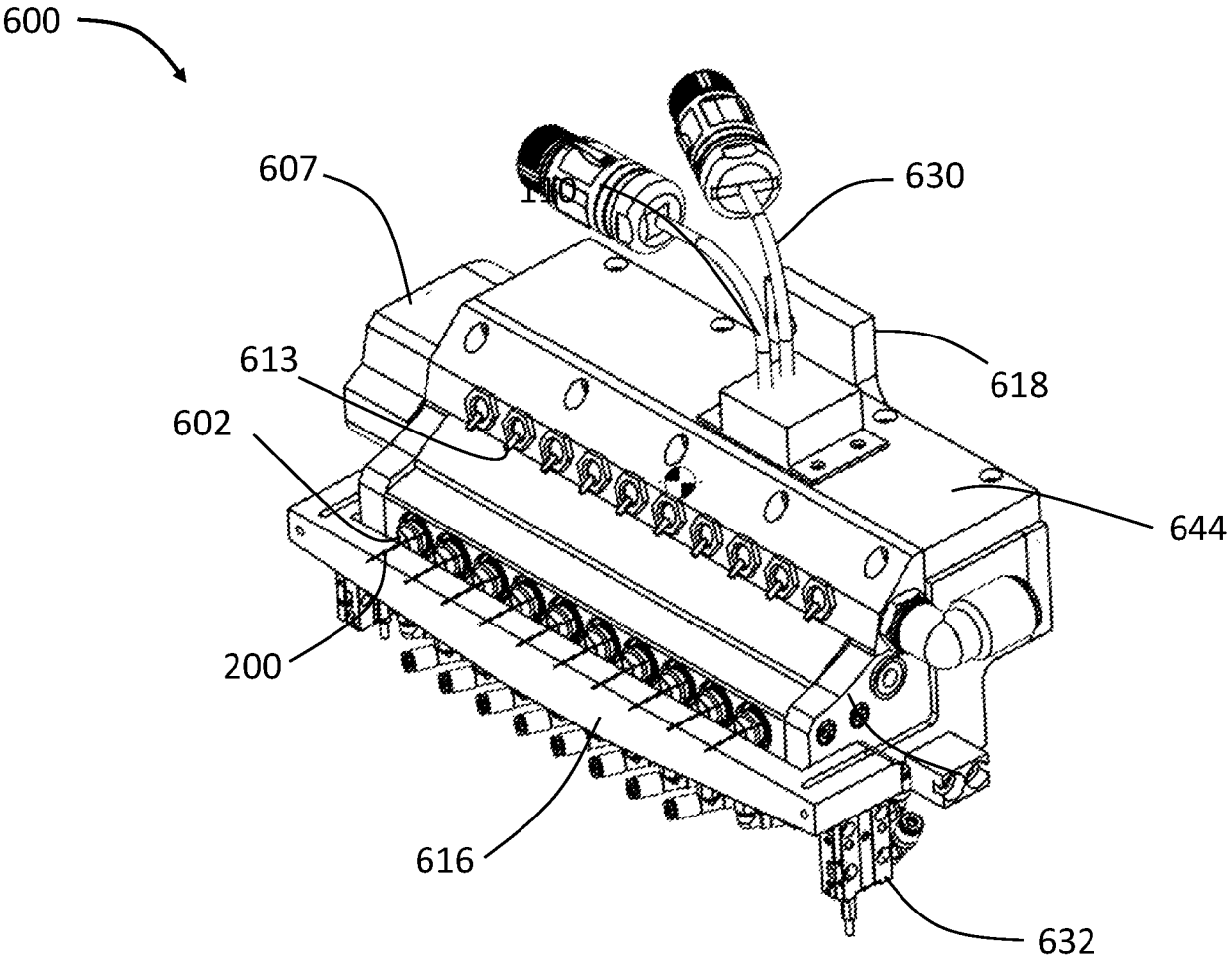
FIG. 13 is a front perspective view of a fixture according to another embodiment of the present disclosure.
Figure 14:
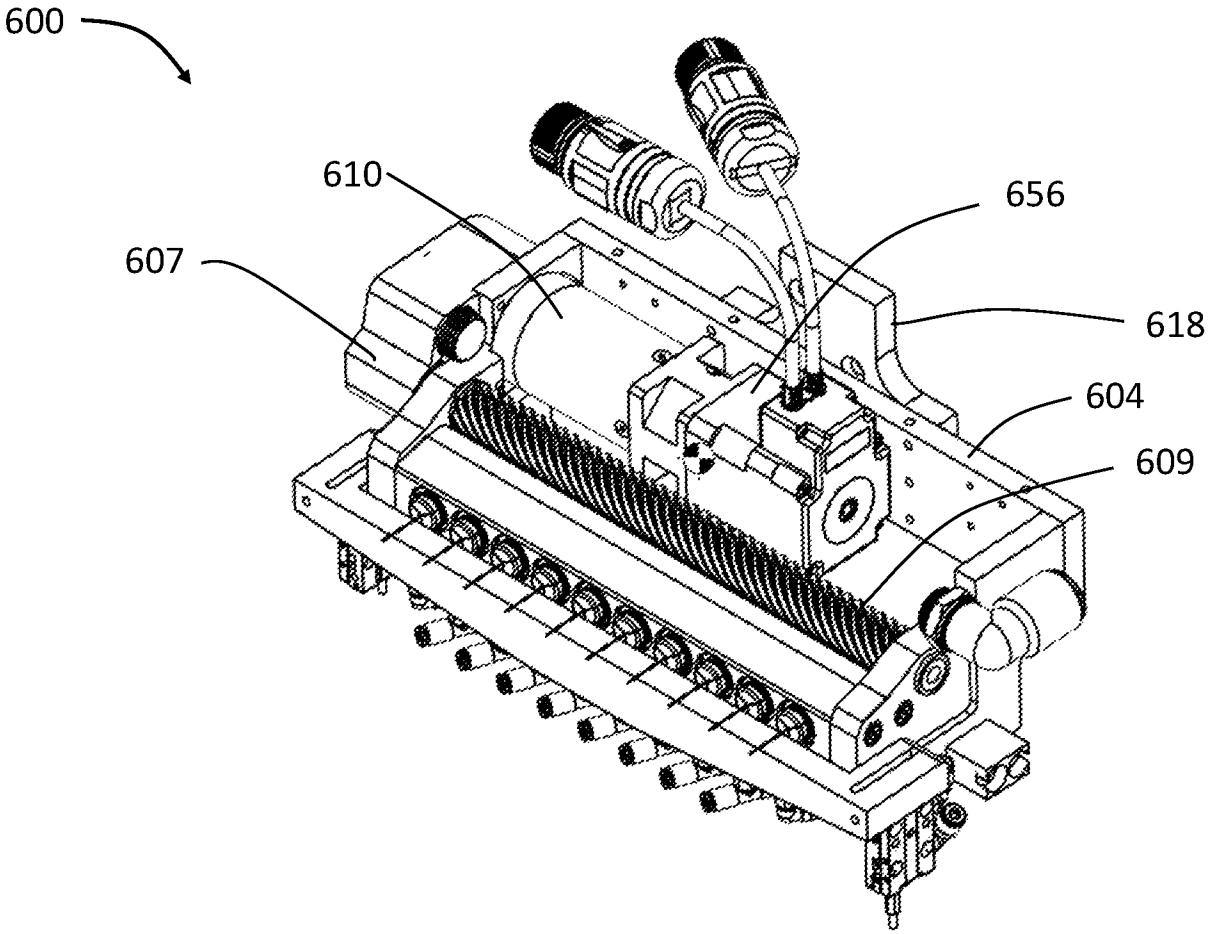
FIG. 14 is a front perspective view of the fixture of FIG. 13, partially disassembled to illustrate an actuator mechanism.

Referring now to FIG. 13, there is shown a front perspective view of a fixture 600 according to another embodiment of the present disclosure. Fixture 600 is similar to fixture 100, and therefore like elements are referred to with similar numerals within the 600-series of numbers. For instance, fixture 600 includes collets 602 to secure workpieces 200, a support structure 616 to minimize or eliminate deflection of workpieces 200 during a machining process such as grinding, and one or more connectors 630 for control and/or power for the fixture. However, as best shown in FIG. 14, shaft 610 and motor 656 of fixture 600 are oriented along fixture 600 transverse to the orientation shown in FIG. 1. That is, shaft 610 and motor 656 are desirably oriented orthogonally to a direction defined between robot head 402 and the ends of workpieces 200. As illustrated in FIG. 14, this orientation reduces the distance between robot head 402 (shown in FIG. 11), which is configured to be coupled to recess 636 of fixture 600, and collets 602 holding workpieces 200. Consequently, the moment loading on robot 400 is reducing during the machining operations utilizing fixture 600.

Fixture 600 includes individual coolant nozzles 613 located above collets 602 as shown in FIG. 13. Coolant nozzles 613 located directly above the workpieces provide improved cooling, and consequently improve machining operations. For example, burrs generated during grinding can be reduced or washed away by the individual coolant supply directed to each workpiece by their respective nozzle 613. Fluid pathways through fixture 600 are provided for readily connecting a coolant source to supply coolant to nozzles 613. As the fluid pathways are located within fixture 600, coolant supply to workpieces 200 can be conveniently maintained and controlled through the various machining operations.

Figure 15:
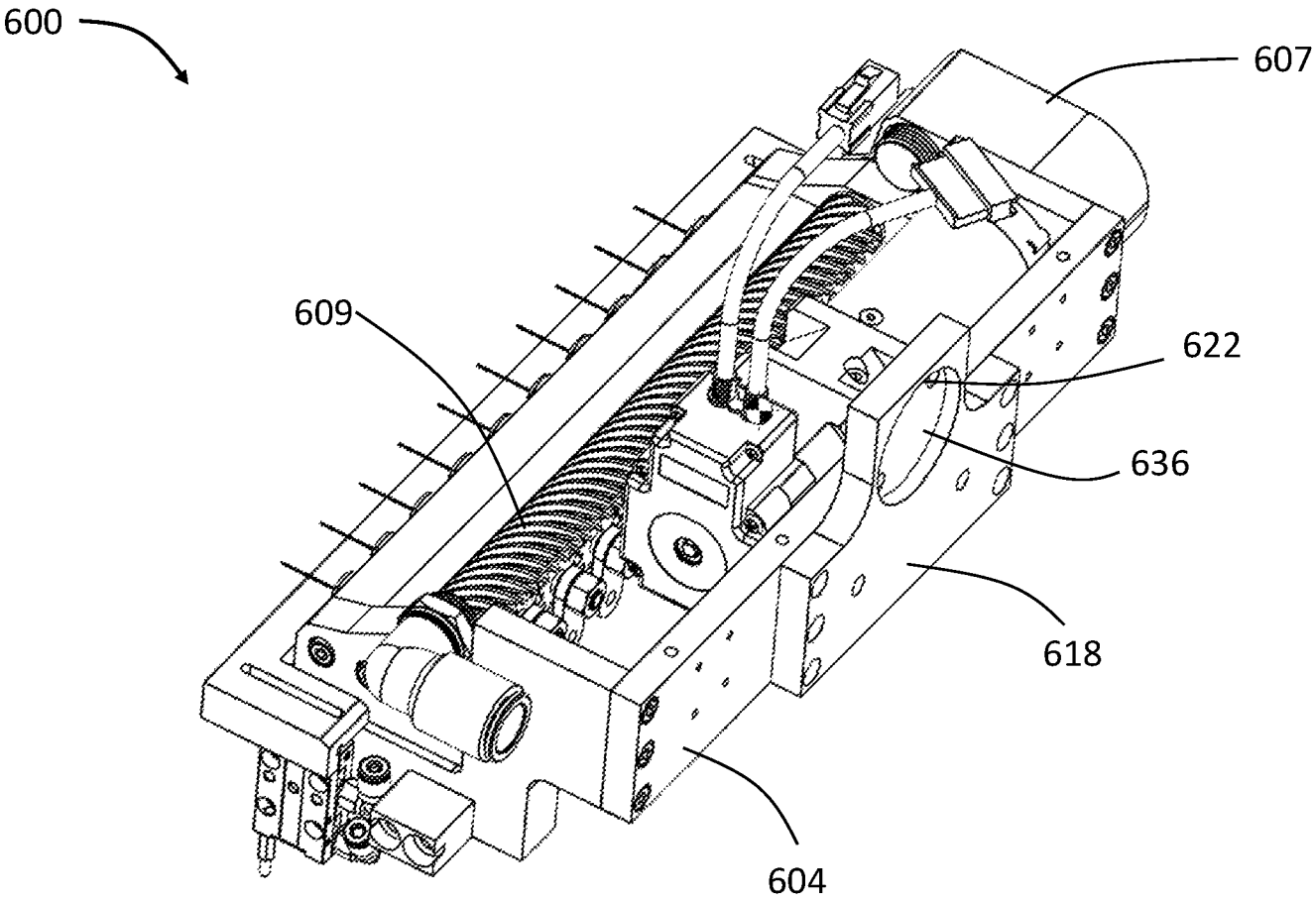
FIG. 15 is a back perspective view of the partially disassembled fixture of FIG. 13.
Figure 17:
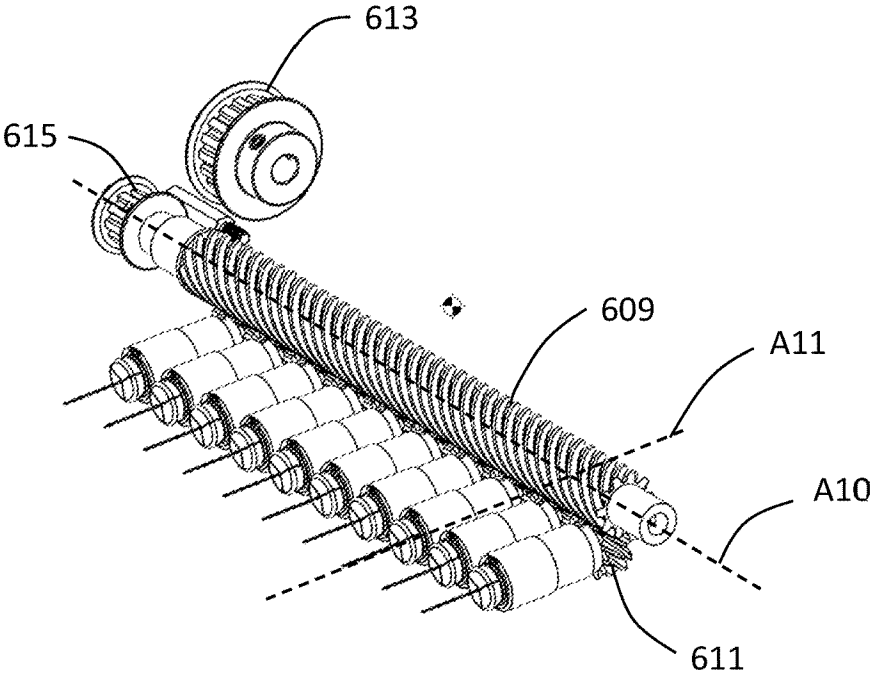
FIG. 17 is a front perspective view of the actuator mechanism of FIG. 16, partially disassembled to illustrate its components.
Figure 16:
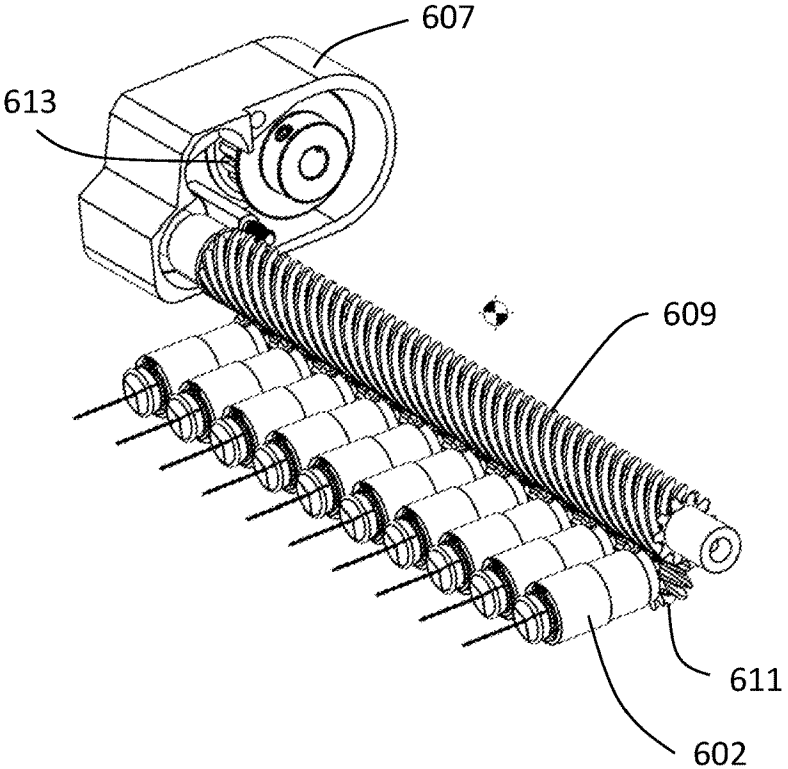
FIG. 16 is a front perspective view of the actuator mechanism of the fixture of FIG. 13.

FIGS. 15-17 illustrate the actuator mechanism of fixture 600. The actuator mechanism includes a main helical gear 609 extending across fixture 600. Each collet 602 has a collet helical gear 611 coupled to main helical gear 609 as best shown in FIGS. 16 and 17. Rotation of main helical gear 609 around a rotation axis A10 will simultaneously rotate all collet helical gears 611 around axis A11 as shown in FIG. 17. Rotation axis A10 is parallel or substantially parallel to shaft 610. Thus, all workpieces 200 can be simultaneously rotated by rotating main helical gear 609. A driven gear 615 located on one end of main helical gear 609 is connected to a driver gear in the form of shaft gear 613 via a belt, chain, intermediate gear, or similar type of drive connection. Gears 609 and 615 may be precision ground spur gears that provide continuous and unrestrained rotation of workpieces while eliminating backlash to provide for precise workpiece rotation, although other types of gears (e.g., helical) may alternatively be used. Shaft gear 613 is controlled by the rotation of shaft 610. Thus, rotating shaft 610 controls the simultaneous rotation of each workpiece 200. A pulley cover 607 houses driven gear 615 and shaft gear 613 as shown in FIG. 16. It is believed that a benefit of utilizing a helical gear arrangement like that shown in FIGS. 16-17, instead of a rack-and-pinion style arrangement as shown in FIG. 3, is that the helical gear arrangement is not limited in how far the collets 602 can be rotated in any one direction. Beneficially, in combination with the ease of programming the system to fabricate a variety of different components (as discussed above), the helical gear arrangement may provide more flexibility in the types of components that can be fabricated. For example, the limitless rotation in any direction may make it easier to grind conical tips onto the workpieces 200.

Figure 18:
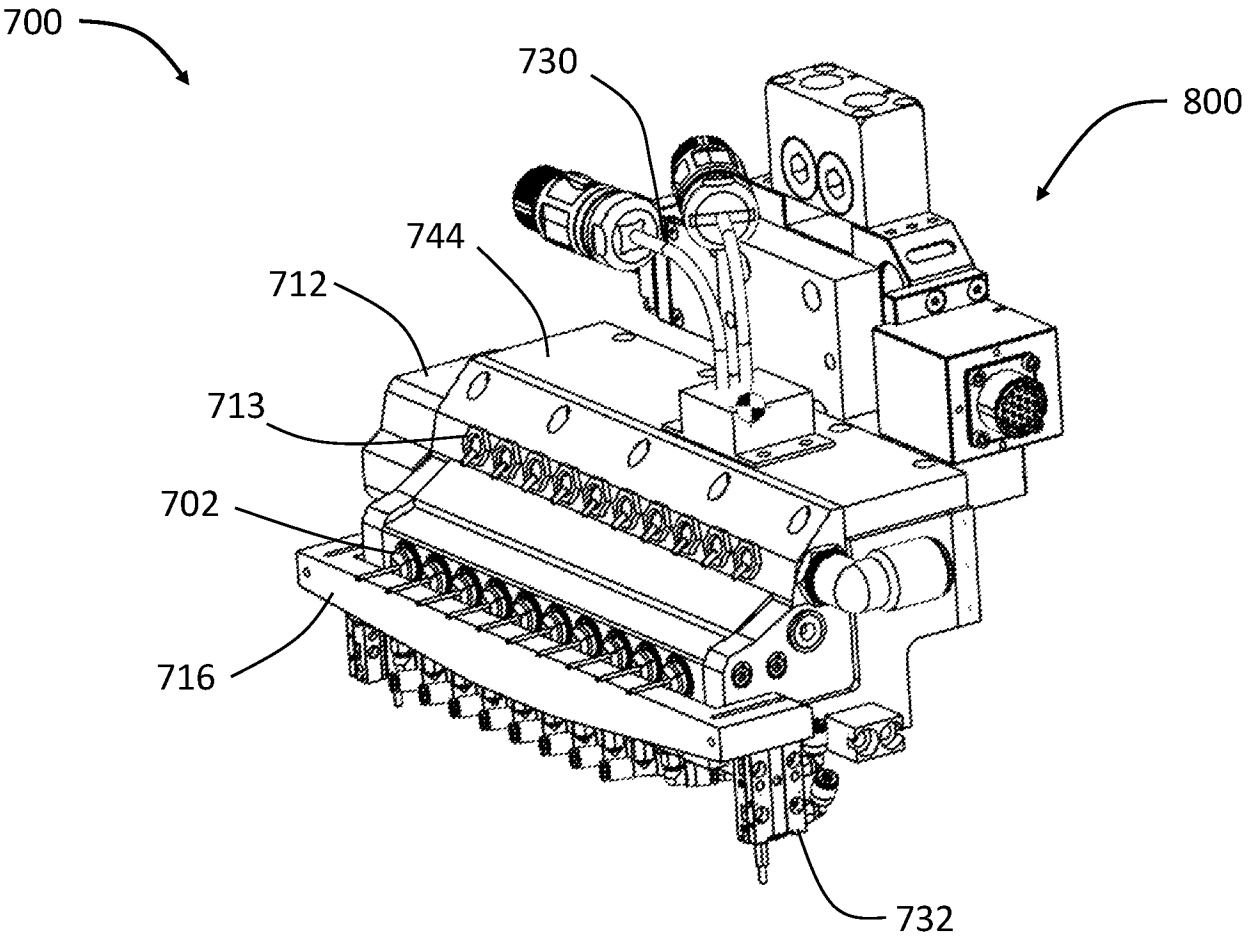
FIG. 18 is a front perspective view of a fixture according to another embodiment of the present disclosure.

Referring now to FIG. 18, there is shown a fixture 700 with a tool changer 800 according to another embodiment of the present disclosure. Fixture 700 is similar to fixture 600, and therefore like elements are referred to with similar numerals within the 700-series of numbers. For instance, fixture 700 includes collets 702 to secure workpieces 200, a support structure 716 to minimize or eliminate deflection of workpieces 200 during a machining process such as grinding, and one or more connectors 730 for control and/or power for the fixture. Tool changer 800 coupled to fixture 700 enables quick and easy connection to robot 400.

Figure 19:
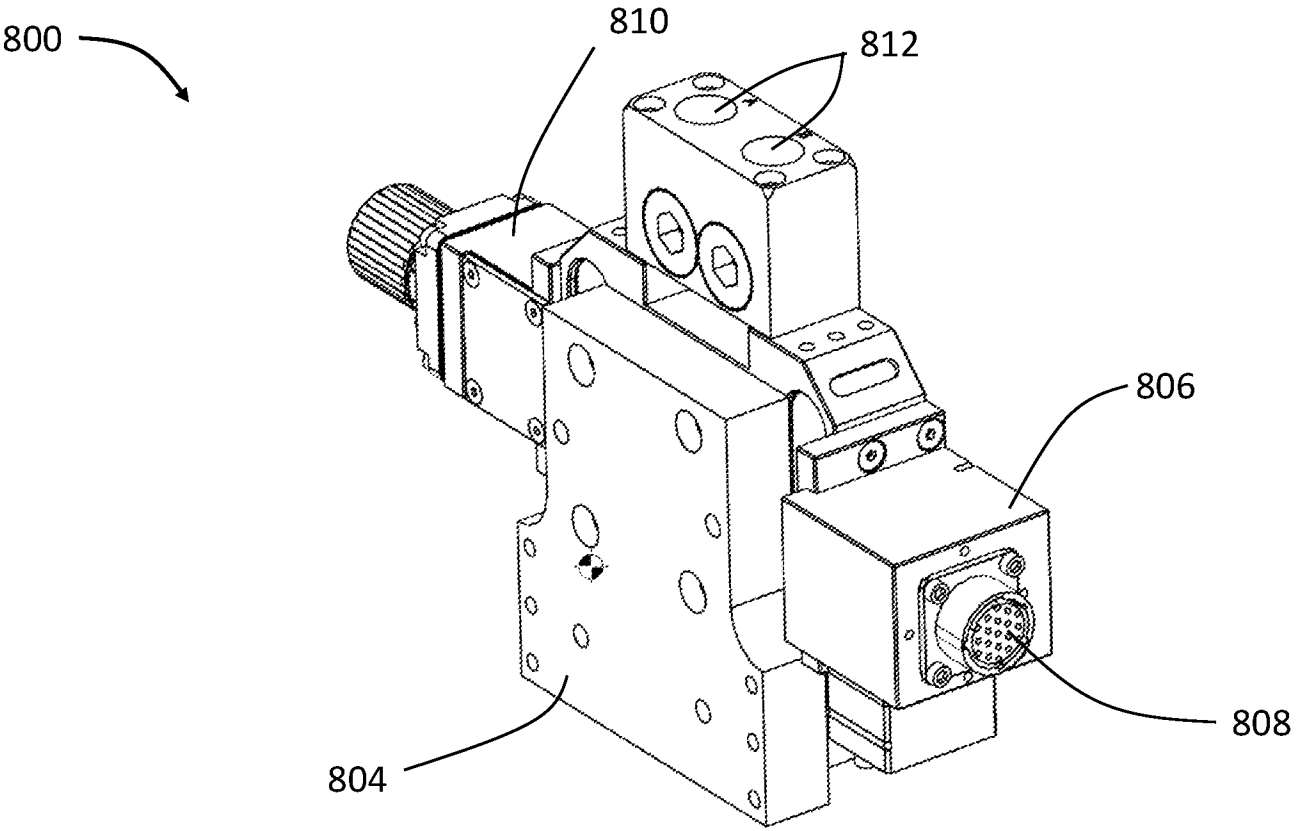
FIG. 19 is a front perspective view of a tool changer of the fixture of FIG. 18.
Figure 20:
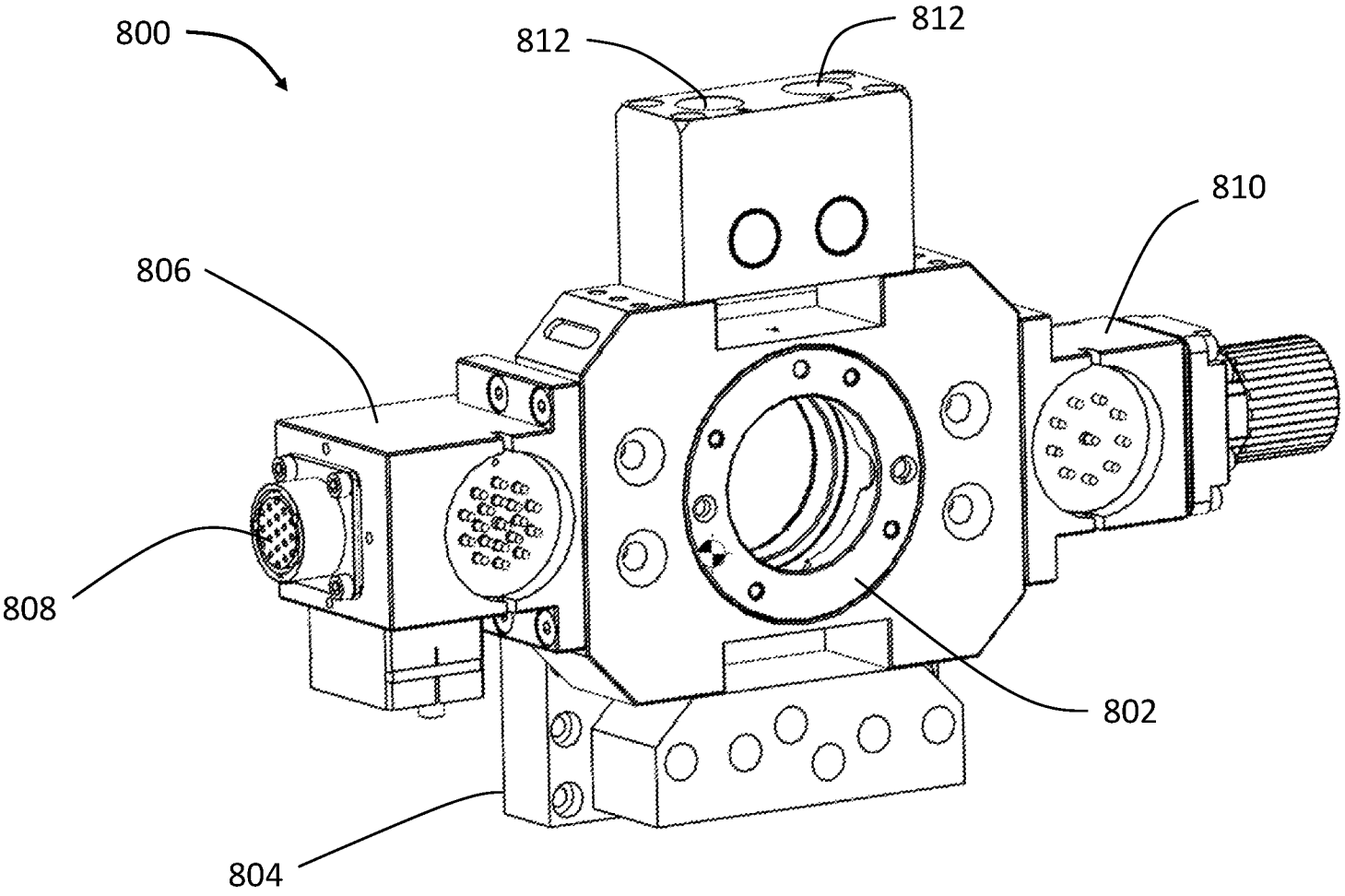
FIG. 20 is a back perspective view of the tool changer of FIG. 19.

Tool changer 800 includes a fixture attachment end 804 and a robot attachment 802 as best shown in FIGS. 19 and 20, respectively. Fixture attachment end 804 is attached to a bracket 604 on fixture 600 (FIG. 15). Robot attachment 802 provides a quick-change interface that can be readily attached to a robot. Various electrical connections such as modules 806 and 810 with male and female pin 808 arrangements are coupled to tool changer 800 to provide electrical interfaces between fixture 700 and robot 400 via tool changer 800. Multiple pass-through ports 812 on tool changer 800 allow for fluid pathways between fixture 700 and an external source via tool changer 800. For example, a coolant reservoir can be coupled to tool changer 800 to supply coolant to workpieces 200 via fixture 700 (e.g., via coolant nozzles 713) during various machining operations. Robot 400 can be programmed to automatically select a desired fixture by interfacing with a tool changer coupled to the selected fixture.

While a trocar is generally described as an example of cannula in the various embodiments of the present disclosure, the embodiments can be used for any cannula type such as, but not limited to, a back bevel tip needle, a bias grind needle, a diamond point needle, a Menghini needle, a probe point needle, a razor edge needle, a styler, a tri-facet lancet, etc.

Furthermore, although the invention disclosed herein has been described with reference to particular features, it is to be understood that these features are merely illustrative of the principles and applications of the present invention. It is therefore to be understood that numerous modifications, including changes in the sizes of the various features described herein, may be made to the illustrative embodiments and that other arrangements may be devised without departing from the spirit and scope of the present invention. In this regard, the present invention encompasses numerous additional features in addition to those specific features set forth in the paragraphs below. Moreover, the foregoing disclosure should be taken by way of illustration rather than by way of limitation as the present invention is defined in the examples of the numbered paragraphs, which describe features in accordance with various embodiments of the invention, set forth in the claims below.

The invention claimed is:

1. A fixture for holding a plurality of workpieces, the fixture comprising:

a frame;

a plurality of holders, each holder having a substantially circular opening defining a variable diameter configured to receive and secure a workpiece, each holder being rotationally coupled to the frame, the variable diameter configured to be increased or decreased to receive and secure the workpiece;

an actuator operatively coupled to the plurality of holders to drive rotation of the holders with respect to the frame; and a bracket configured to mount the frame to a manipulator, wherein the manipulator is configured to move the fixture, wherein each of the holders are coupled to a respective holder gear, and wherein the actuator includes a shaft having a single shaft gear, wherein the shaft gear is operatively coupled to the holder gears to drive rotation of the holders with respect to the frame.

2. The fixture of claim 1, wherein the holders are collets configured to releasably secure the workpieces.

3. The fixture of claim 1, wherein the shaft gear is operatively coupled to the holder gears by a linear actuator.

4. The fixture of claim 3, wherein the linear actuator includes a rack gear driven by a pinion comprising the shaft gear.

5. The fixture of claim 1, wherein the actuator includes an electric motor for driving rotation of the shaft.

6. The fixture of claim 1, wherein the shaft gear is operatively coupled to the holder gears by a first helical gear.

7. The fixture of claim 6, wherein the first helical gear is parallel to the shaft.

8. The fixture of claim 7, wherein the first helical gear is operatively coupled to the shaft gear by a pulley drive.

9. The fixture of claim 8, wherein the pulley drive includes a continuous loop coupling the shaft gear to the first helical gear.

10. The fixture of claim 1, wherein the fixture incudes a support structure located away from the holders to minimize or eliminate workpiece deflection during a machining operation.

11. The fixture of claim 1, wherein the manipulator is robot.

12. The fixture of claim 11, wherein the robot includes an arm having a distal end including a rotational actuator, and wherein the fixture is configured to be coupled to the distal end of the arm such that the actuator of the fixture is operatively coupled to the rotational actuator of the robot.

13. A fixture for holding a plurality of workpieces, the fixture comprising:

a frame;

a plurality of holders, each holder configured to receive and secure a workpiece, each holder being rotationally coupled to the frame;

an actuator operatively coupled to the plurality of holders to drive rotation of the holders with respect to the frame; and a bracket configure to mount the frame to a manipulator, the manipulator being configured to move the fixture, wherein each of the holders are coupled to a respective holder gear, and wherein the actuator includes a shaft having a shaft gear, wherein the shaft gear is operatively coupled to the holder gears to drive rotation of the holders with respect to the frame, the shaft gear being operatively coupled to the holder gears by a first helical gear, the first helical gear being parallel to the shaft, the first helical gear being operatively coupled to the shaft gear by a pulley drive.

14. The fixture of claim 13, wherein the pulley drive includes a continuous loop coupling the shaft gear to the first helical gear.

* * * * *